US005921154A

United States Patent [19]

Barfield et al.

[11] Patent Number: 5,921,154

[45] Date of Patent: Jul. 13, 1999

[54] ACCESSORY FOR OPENING EASY-OPEN BOTTLES WITH TWIST-OFF CAPS

[76] Inventors: Norma Y. Barfield, 425 S. Hale, Palatine, Ill. 60067; Laurie A. Berg, 335 Oak St., Elgin, Ill. 60123

[21] Appl. No.: 08/595,910

[22] Filed: Feb. 6, 1996

[51] Int. Cl.[6] ..... B67B 7/14

[52] U.S. Cl. ..... 81/3.41; 81/3.07

[58] Field of Search ..... 81/3.41, 3.43, 81/3.4, 3.07, 177.3; 7/151

[56] References Cited

U.S. PATENT DOCUMENTS

| | | | |
|---|---|---|---|
| 2,771,802 | 11/1956 | Lewis | 81/3.43 |
| 4,037,495 | 7/1977 | Beckstead | 81/64 |
| 5,038,644 | 8/1991 | Delsack | 81/177.3 |
| 5,257,566 | 11/1993 | Schultz | 7/151 |
| 5,329,832 | 7/1994 | Tegethoff | 81/3.41 |
| 5,458,027 | 10/1995 | Rambin | 81/3.43 |

FOREIGN PATENT DOCUMENTS

| | | | |
|---|---|---|---|
| 2410625 | 8/1979 | France | 81/3.43 |
| 2255082 | 10/1982 | United Kingdom | 81/3.41 |

*Primary Examiner*—David A. Scherbel
*Assistant Examiner*—Joni B. Danganan
*Attorney, Agent, or Firm*—Charles F. Lind

[57] ABSTRACT

A hand-mounted accessory for opening a twist-off cap bottle, the accessory being comprised of an elongated flexible web and flexible loops off the web near its opposite ends. The flexible loops are sized to fit over and be secured onto the user's thumb and index finger in the region between the first and second knuckles, the web ending near the second knuckles and between the loops then lying closely proximate and substantially aligned with the hand web portion between the thumb and index finger. The web is further sized to wrap more than half-way around and overlie the side edges of the twist-off cap even if the web is not exactly aligned parallel to the side edges. As hand-mounted, the accessory web automatically will be positioned against the cap side edges as the user's thumb and index finger close over the cap side edges during hand manipulation needed to twist the cap off the bottle.

4 Claims, 1 Drawing Sheet

ACCESSORY FOR OPENING EASY-OPEN BOTTLES WITH TWIST-OFF CAPS

BACKGROUND OF THE INVENTION

One type of easy-open bottles have a neck with exterior helical threads around the defined bottle opening, and a metal closure cap that cooperates with the threads and allows it to be twisted about a quarter turn relative to the bottle to remove it from and open the bottle. Bottles of this type offer the appeal and convenience of being opened without the need of using any conventional opener tool. Beer and carbonated water are common liquids marketed in bottles of this type.

Normally, with the bare-handed thumb, the adjacent index finger, and the fleshy web portion of the hand therebetween wrapped around the sides of the cap, sufficient opening forces can be generated by gripping tightly onto the cap and twisting it off the bottle. However, with soft or sensitive skin, a weak grip, or should the bottle cap or one's hands be wet, the sharp side edges of the cap can dig into, cut or otherwise inflict pain via one's skin, and/or the cap can slip relative to the gripping hand to defeat the intended easy opening appeal of the bottle. To overcome this situation, it is common and generally effective to layer a thin flexible wrap or layer, such as a cloth or perhaps even a paper towel or napkin, between the cap and hand for protecting the hand and reducing pain and/or slippage.

While a conventional bottle opener tool can be used to snap off the cap without twisting it, this defeats the convenience of the easy-open bottle and moreover requires one to go to a tool (if such is mounted permanently on a cooler wall or the like) or to carry or otherwise keep track of the opener tool (if such is portable but not carried).

Special problems arise when professional servers of drinks, such as bartenders, must open many easy-open twist-off cap bottles over a short period, while concurrently handling many other unrelated chores including taking cash payments and making change, or making and serving other drinks. Thus, keeping track of or carrying around a portable opener tool or protective wrap can be a challenge, while otherwise having both hands free; and having a towel and/or opener tool dangle from one's belt can yield a questionable less than professional impression.

Another problem a snap-off opener tool can create is the removed cap is typically unrestrained and can fall to the floor and end up under nearby furniture or the like.

SUMMARY OF THE INVENTION

This invention relates to an accessory device for opening easy-open twist-off caps on bottles.

A basis object of this invention is to provide an accessory device that can be secured very comfortably on one's hand, and worn for extended durations without even appreciating that it is on the hand, thereby allowing its repeated use for gripping and turning easy-open twist-off caps, with minimum difficulty and/or injury, and without impeding other chores.

Another object of this invention is to provide an accessory device according to the previous object that is economical to make, to be available for use by many including professional bartenders or the like.

BRIEF DESCRIPTION OF THE DRAWINGS

These and other objects, features or advantages of the invention will be more fully understood and appreciated after considering the following description of the invention, which includes as a part thereof the accompanying drawings, wherein.

DETAILED DESCRIPTION OF A PREFERRED EMBODIMENT OF THE INVENTION

Figure 1:
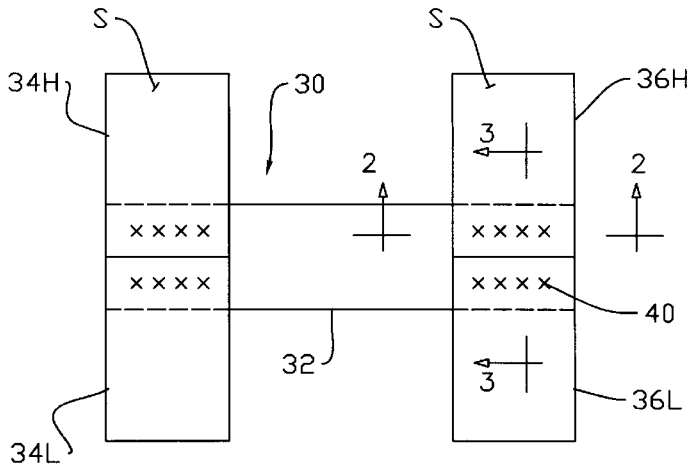
FIG. 1 is a top plan view of a preferred embodiment of the accessory device made according to this invention.
Figure 3:
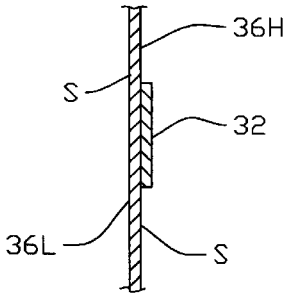
FIGS. 2 and 3 are sectional views as seen respectively from lines 2—2 and 3—3 in FIG. 1.
Figure 2:
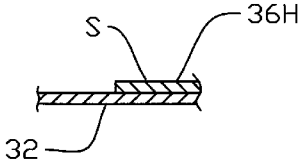
Figure 5:
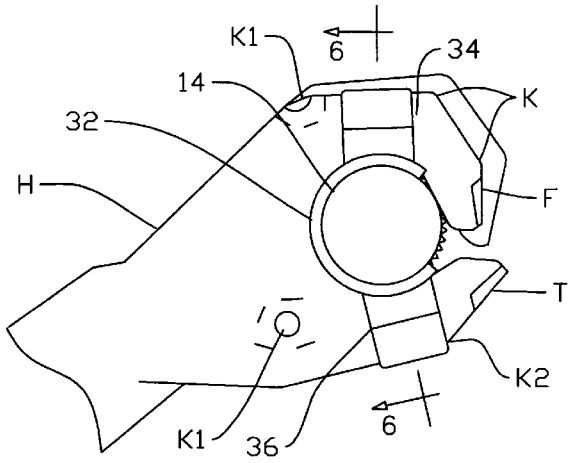
FIG. 5 is a top plan view of the accessory device secured on a user's left hand shown wrapped in a gripping condition around the cap and bottle of FIG. 4 suited to remove the cap and open the bottle; and is
Figure 4:
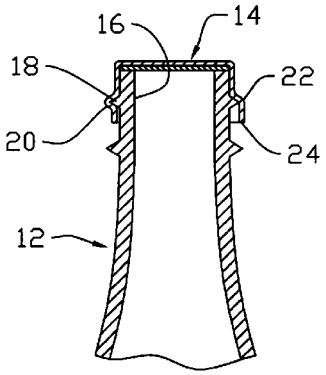
FIG. 4 is a sectional view of a typical easy-open bottle with a twist-off cap thereon in the bottle closed condition.
Figure 6:
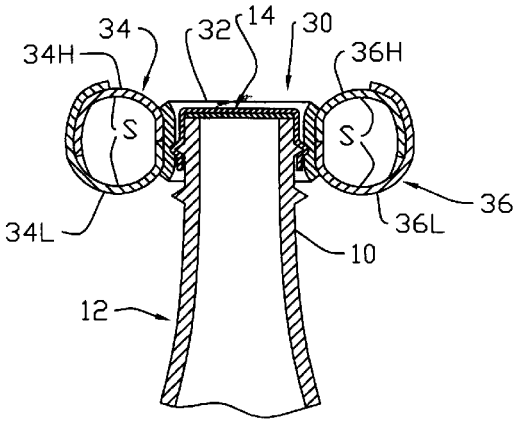
FIG. 6 is an enlarged sectional view as seen from line 6—6 in FIG. 5.

A neck portion 10 of a typical easy-open bottle 12 with a twist-off cap 14 is illustrated in FIGS. 4 and 6, when the cap is secured on the bottle and the bottle is closed. The neck portion 10 defines bottle opening 16, and helical threads 18 are formed on the exterior of the neck adjacent the opening. The cap 14 typically is of metal, and cap sides are crimped or otherwise locked onto the threads 18 after the bottle 12 has been filled with liquid to close and seal the filled bottle. This results in the cap side edges being defined by circumferentially spaced portions 20 and 22 alternately arranged around the bottle neck 10, the spaced portions 22 underlying the threads 18 to actually hold the bottle 12 and cap 14 together and the spaced portions 22 being gapped from the bottle below the threads and terminating at pointed sometimes sharp ends 24. The threads 18 are pitched to provide that about a quarter turn rotation between the bottle and cap effectively removes the cap to open the bottle.

The accessory device 30 for removing the twist-off cap 14 from the bottle 12 is comprised as an elongated web 32 and flexible loops 34 and 36 off the opposite ends of the web. The flexible loops 34, 36 are suited to or sized to fit over the thumb T and index finger F of a user's hand H, respectively between the lowest or first knuckle K1 and the second knuckle K2.

In a preferred embodiment, each loop 34, 36 is formed of elongated inelastic separable straps or ties 34H, 34L and 36H, 36L with cooperating hook-loop fasteners (such as VELCRO) thereon suited when separated for removing the accessory device from the user's hand H, and operable when overlapped to unite the ties together as the loops around the respective thumb T and finger F for holding the accessory device on the hand.

The hook ties 34H and 36H as well as the loop ties 34L and 36L each can have opposite its respective fastener means a smooth backing surface S suited to lie comfortably against the skin of the user's hand, while the separate hook ties 34H and 36H forming the respective loops would face in one direction and the separate loop ties 34L and 36L would face in the opposite direction. The separate ties 34H, 34L and 36H, 36L lastly could overlie the web 32, each either approximately half way across to substantially butt near the center of the web (as illustrated) or completely across the web to overlap one another (not shown), and each then secured to the web as by appropriate stitching 40.

The web 32 would be of sufficient length to have its mid-part between the loops lie closely proximate and preferably even against the fleshy web portion W of the hand between the thumb T and index finger F, when the loops 34, 36 are connected on the user's hand. Normally, this would further provide that the web 32 would be of sufficient length to wrap more than half way, and more commonly mostly, around the periphery of the cap sides.

This allows the thumb T and index finger F, between the first and second knuckles K1 and K2, to be closed around or over the cap, in a tight gripping position, with the web 32 positioned against the opposite cap sides; while it yet also allows the thumb and index finger to be spread or opened widely apart without the accessory device 30 hindering such movement.

The web 32 preferably would be of sufficient width to overlie and cover the sides of the cap 14 even if the web were not exactly aligned parallel to the circumference of the cap. The web 32 can be formed of a flexible durable preferably inelastic material, such as of a strap or belt of woven nylon or canvas, or of a vinyl sheet, and of a thin cross-section. Nonetheless, the preferred web will be of sufficient thickness to cushion the hand from the sharp cap edges, and of sufficient stiffness to generally hold its strap or belt-like shape as it is flexed when used.

The loops 34, 36 preferably should be less in width than the spacing between the respective knuckles K1 and K2 to fit comfortably therebetween without hindering thumb or finger bending at the respective second knuckle K2.

The accessory device 30 can be secured comfortably onto one's hand, either the right or the left, and worn for extended durations without even appreciating its presence, allowing use by bartenders or the like for repeatedly opening twist-off caps, without discomfort or difficulty, and otherwise bare-handed and with two free hands for completing other working chores. This accessory device, being symmetrical, allows either loop to fit on either the thumb or the index finger, or the web to be flipped over for selectively exposing both of its sides to the cap for extended durability and service life. If desired, the accessory device 30 could be made of material having one's skin color for even further reducing its appreciated presence.

By way of example, the web can be between approximately ½ and 1 inch wide, between approximately 2 and ½, and 4 inches long, and between possibly 1/32 and 1/8 inch thick; the loops can be between approximately ½ and 1 inch wide; and the loops can be separated from one another along the web by between approximately 1 and ½, and 3 inches.

While a specific embodiment has been illustrated, it will be obvious that minor changes could be made therefrom without departing from the spirit of the invention. For example, the loops could be made permanently closed, to fit somewhat as rings over the respective thumb and index finger. Also, the loops could be made of a flexible durable elastic material, and sized to provide a tight but resilient fit on the thumb and index fingers. Accordingly, the invention is to determined by the scope of the following claims.

What is claimed is:

1. An accessory to be mounted on the hand of its user for opening an easy-open bottle having a twist-off cap with side edges terminating along circumferentially extended sharp ends, comprising the combination of an elongated flexible web and flexible loops attached to and extended laterally off the web near at opposite ends of the web, the web being of sufficient length to wrap more than half-way around the circumferential periphery of the cap side edges and of sufficient width to overlie and cover the cap side edges even if the web is not exactly aligned parallel to the side edges, the web also being sized relative to the user's hand when secured thereon to overlie the thumb and index finger between respective second knuckles thereof and the hand web portion between the thumb and index finger, with its said opposite ends then being near the second knuckles and the flexible loops then being suited to fit over and be secured onto the user's thumb and index finger in the region between respective first and second knuckles thereof, effective to hold the accessory with the web between the loops closely proximate and aligned substantially with the hand web portion even during hand manipulation, whereby the accessory web will automatically be positioned against the cap side edges to isolate the user's thumb, index finger and hand web portion from the cap side edges and sharp ends as the user's thumb and index finger close over the cap side edges during hand manipulation needed to hand grip and twist the cap off the bottle and can remain secured on the hand while allowing other normal unrelated hand manipulations.

2. The accessory according to claim 1, further comprising each loop being formed of elongated inelastic separable straps with cooperating hook-loop fasteners thereon suited when separated for removing the accessory device from the user's hand and operable when overlapped to unite them together as closed loops that can be secured around the user's thumb and index finger, and the separated loop straps being extended substantially transverse to the length of the web at its opposite ends making the accessory when laid flat shaped similar to a capital letter "I".

3. The accessory according to claim 2, further comprising the web being formed of durable inelastic material somewhat as a strap of woven nylon or canvas or as a sheet of vinyl, and the web being thin but yet of sufficient thickness to isolate and effectively cushion the hand from the cap side edges and sharp ends.

4. The accessory according to claim 3, further comprising the loop straps being less in width than the spacing between the respective first and second knuckles to fit comfortably therebetween without hindering thumb or finger bending at the respective knuckles.

* * * * *